United States Patent [19]

Wiegner

[11] 4,174,035

[45] Nov. 13, 1979

[54] TWO-COMPONENT CONTAINER AND PACKAGE

[76] Inventor: Georg Wiegner, Breslauer Str. 35, Viersen, Fed. Rep. of Germany

[21] Appl. No.: 924,132

[22] Filed: Jul. 13, 1978

Related U.S. Application Data

[63] Continuation-in-part of Ser. No. 720,154, Sep. 30, 1976, Pat. No. 4,103,772.

[30] Foreign Application Priority Data

Sep. 4, 1975 [DE] Fed. Rep. of Germany ..... 2539291

[51] Int. Cl.[2] ..... B65D 25/08

[52] U.S. Cl. ..... 206/222

[58] Field of Search ..... 206/219, 222, 498; 215/6, DIG. 8; 222/81, 83, 85; 259/48, DIG. 20

[56] References Cited

U.S. PATENT DOCUMENTS

| | | | |
|---|---|---|---|
| 2,631,521 | 3/1953 | Atkins, Jr. | 206/222 X |
| 2,653,611 | 9/1953 | Smith | 206/222 X |
| 2,773,591 | 12/1956 | Jensen | 206/222 X |
| 3,347,410 | 10/1967 | Schwartzman | 206/222 X |
| 3,349,966 | 10/1937 | Schwartzman | 206/222 X |
| 3,521,745 | 7/1968 | Schwartzman | 206/222 |
| 3,970,068 | 7/1976 | Sato | 206/219 X |
| 4,103,772 | 8/1978 | Wiegner | 206/222 |

*Primary Examiner*—George T. Hall

*Attorney, Agent, or Firm*—Toren, McGeady and Stanger

[57] ABSTRACT

The rims of two plastic cups are heat sealed to each other by means of an interposed, plastic-coated aluminum foil which seals the cavities of the two cups and their contents from each other and constitutes the sole fastening element connecting the cups. At least one integral, plastic piercing thorn projects from the flexible bottom wall in the cavity of one cup, and manual pressure applied to the exposed outer face of the bottom wall may cause the blade to pierce the aluminum foil so that the contents of the two cavities may be mixed and thereafter discharged through a normally plugged spout on one bottom wall.

9 Claims, 2 Drawing Figures

TWO-COMPONENT CONTAINER AND PACKAGE

This application is a continuation-in-part of my copending application Ser. No. 720,154, filed on Sept. 3, 1976, now U.S. Pat. No. 4,103,772.

This invention relates to containers in which individually durable components of a short-lived mixture may be stored for an extended period, and thereafter mixed while protected from the atmosphere. More specifically, the invention relates to a two-component container and to a package including the container and two different liquids sealed from each other in the container.

Containers and packages of the type described find a wide field of application wherever measured amounts of two liquid components need to be mixed immediately prior to use because the mixture itself is not stable. Certain hair coloring compositions including a dye solution and a solution of hydrogen peroxide, and two-component expoy resin adhesives are merely representative of materials stored to advantage in the containers of the invention.

The containers need to be inexpensive enough to be disposable in most applications for which they offer their most important advantages, and it is important that they be made from a minimal number of components consisting of cheap materials and assembled at low cost.

According to one aspect of this invention, there is provided a container comprising a first shell and a second shell, each shell being cup-shaped and bounding a cavity. The side wall of each shell has an annular rim portion which bounds an open side of the shell cavity remote from the bottom wall. The rim portions are fixedly fastened to each other by a frangible partition of sheet material whose opposite major faces are fixedly fastened respectively to the rim portions of the two shells and seal the open sides of the shell cavities. A piercing member is integrally fastened to the bottom wall of the first shell in the cavity of the latter for movement with the integral portion of the bottom wall into piercing engagement with the partition.

According to another aspect, the invention provides a package including a container as defined above, and two liquids sealed from each other and from the ambient atmosphere in the shell cavities by the shells and the partition.

Figure 1:
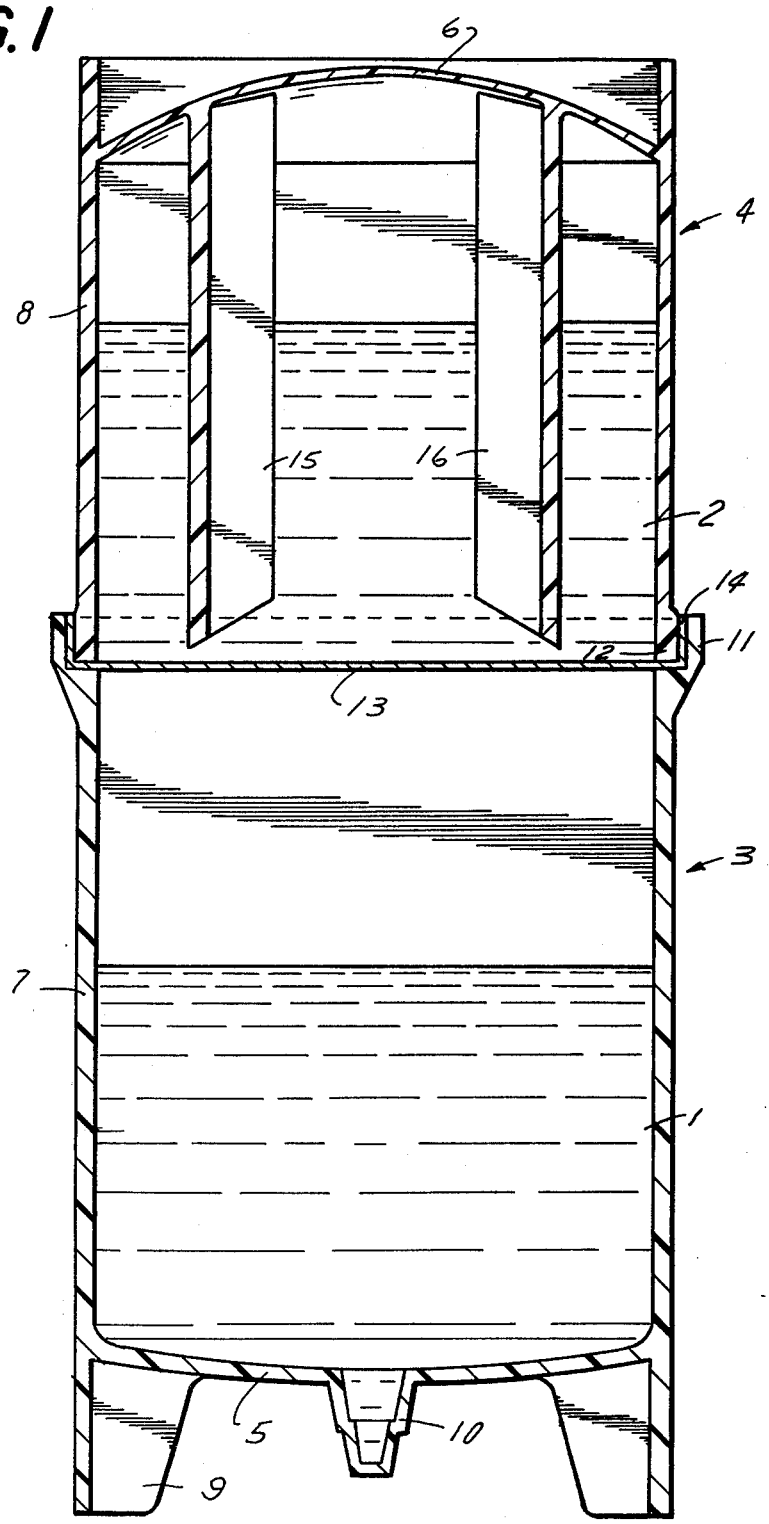
Figure 2:
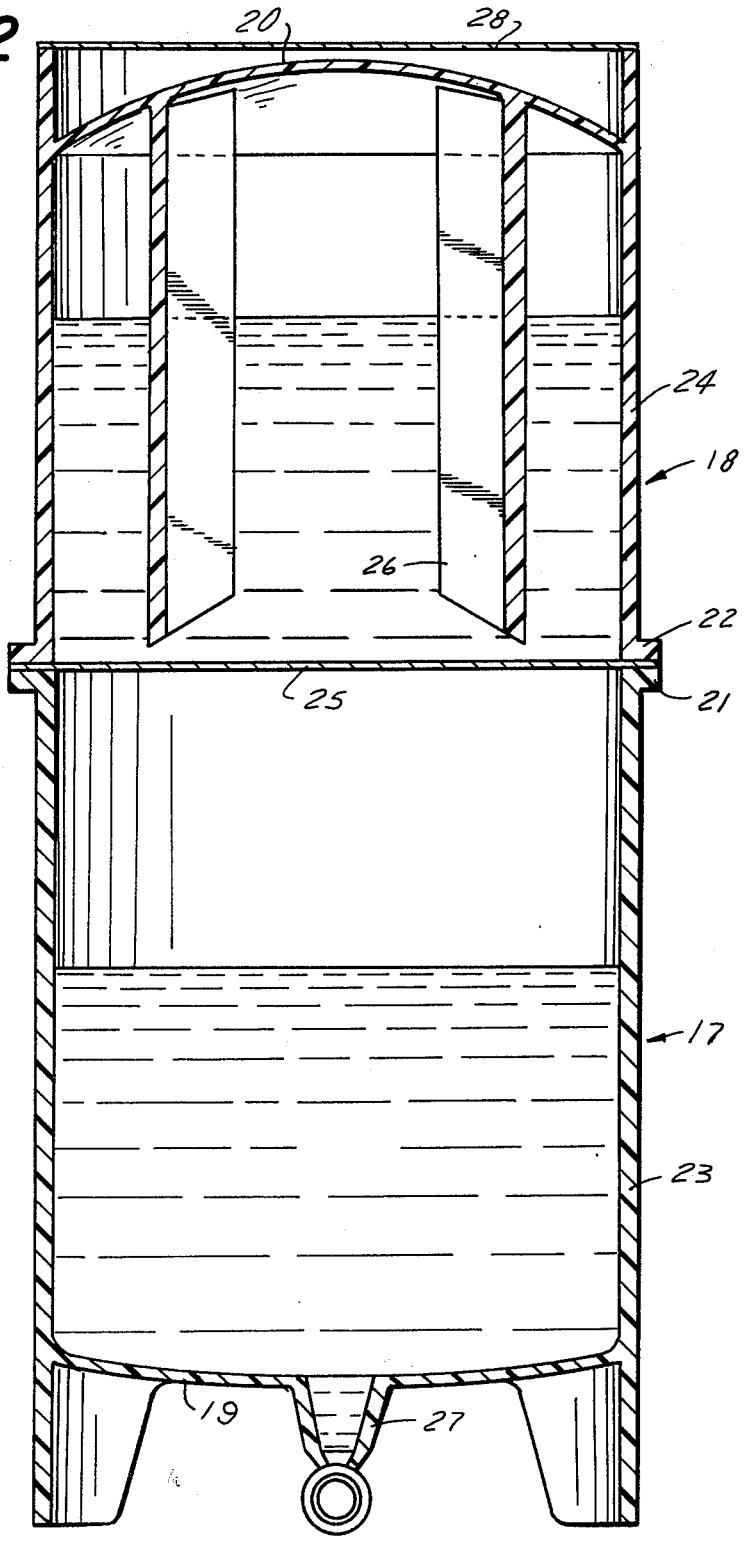

Other features, additional objects, and many of the attendant advantages of this invention will readily be appreciated as the same becomes better understood by reference to the following detailed description of preferred embodiments when considered in connection with the appended drawing in which:

FIG. 1 shows a two-component package of the invention in elevational section; and FIG. 2 illustrates a modification of the package of FIG. 1 in a corresponding view.

The package shown in FIG. 1 contains two different liquids 1, 2 respectively sealed in the cavities of two shells 3, 4 which are plastic cups of square cross section. The bottom walls 5, 6 of the two shells are approximately circularly arcuate in the sectional view of FIG. 1, their concave faces being directed inward of the shell cavities, their convex faces being exposed to the atmosphere. The side walls 7, 8 are of identical cross section over most of their height, and both extend slightly beyond the associated bottom walls 5, 6 to protect the cylindrically convex faces of the bottom walls. The projecting portion of the side wall 7 is notched so as to form four legs 9 on which the container may rest. An integral spout 10 centrally projects outward from the bottom wall 5 and is plugged in the illustrated sealed condition of the package.

The rim portions 11, 12 of the side walls 7, 8 which bound the open sides of the shells 3, 4 opposite the bottom walls 5, 6 are enlarged. The rim portion 11 is offset transversely from the main portion of the side wall 7 to provide an annular shoulder to which the weight of the inverted shell 4 may be transmitted. The rim portion 12 is slightly thickened for greater rigidity. An aluminum foil 13 has two planar, major faces respectively directed toward and sealing the open sides of the shells 3, 4 and the annular, marginal portion 14 of the foil is turned up and is interposed between the cylindrical faces of the rim portions 11, 12, the term cylindrical being understood in its broadest geometrical sense and relating to a surface generated by a straight line moving always parallel to a given straight line and intersecting a directrix, the directrix in this instance being a square, closed loop.

As is not capable of being illustrated on the scale of the drawing, the two major faces of the foil 13, including the marginal portion 14, are coated with respective thin layers of the same synthetic resin composition which constitutes the shells 3, 4 and integrally sealed to corresponding cylindrical and transverse surfaces of the rim portions 11, 12. The coated foil 13 thus provides a partition sealing the cavities of the two shells 3, 4 from each other and constitutes the sole fastener which fastens the cups to each other.

The bottom wall 6 is thinner, and therefore more flexible than the associated side wall 8. It carries two integral piercing thorns 15, 16 which are V-shaped in cross section for greater rigidity, as more fully illustrated in my afore-mentioned copending application, and elongated from the bottom wall 6 toward the partition 13. Their free end faces near the partition are obliquely inclined so as to present a cutting point to the partition. When the exposed, convex face of the bottom wall 6 is pushed manually inward of the shell 4, the thorns 15, 16 pierce the partition 13 and permit the liquids 1, 2 to be mixed while still protected from the atmosphere. The plastic spout 10 may thereafter be cut off and the mixture released from the connected shell cavities at a rate controlled by manual displacement of the bottom wall 6 in the manner conventional in an eye dropper, and particularly convenient in the application of a hair coloring agent.

The modified package illustrated in FIG. 2 is closely similar to that described above with reference to FIG. 1, and only its distinguishing features will be described.

The two cup-shaped shells 17, 18 are of circular cross section so that their bottom walls 19, 20 are spherically arcuate. The respective rim portions 21, 22 of their side walls 23, 24 are radial flanges whose planar, radial faces receive therebetween a flat, plastic-coated aluminum foil 25, the coating layers on the two major faces of the foil 25 being heat sealed to the flanges 21, 22 respectively. Two piercing thorns 26, identical with the corresponding elements described with reference to FIG. 1, are integral with the flexible bottom wall 20, and a normally plugged spout 27 depends from the center of the bottom wall 19. Another frangible foil 28 of aluminum or other sheet material bars access to the bottom wall 20 until broken.

The containers illustrated in FIGS. 1 and 2 respectively differ slightly in the manner in which they are charged with pairs of liquids. In charging the container of FIG. 1, the shells 3, 4 are set on a support with their open sides upward. The desired amount of liquid 1, 2 is then introduced into the shells, the coated aluminum foil 13 is placed over the open top of the shell 4 and its marginal part 14 is crimped over the rim portion 12. If the liquid 2 is viscous, and the foil part 14 is crimped tightly over the rim portion 12, the shell 4 may be inverted into the illustrated position, and its foil-covered rim portion 12 introduced into the expanded, tightly fitting rim portion 11 of the shell 3. Assembly is completed by induction heating of the marginal foil part 14 to a temperature sufficient to cause the coating layers on the foil to be bonded integrally to the synthetic resin composition of the shells.

In the absence of a mechanical interlock between the flanges 21, 22 and the coated foil 25, the container illustrated in FIG. 2 requires two heat-sealing steps. Either charged shell 17, 18 is covered with the foil 25, and the foil is sealed to the flange on which is rests. The shell may thereafter be inverted, placed on the other shell in a manner obvious from the drawing, and assembly completed by another heat-sealing step. The protective foil 28 may be applied to the annular edge of the shell 18 about the bottom wall 20 at any time during the assembly operation.

The shells and their integral appendages, such as the piercing thorns and spouts, are readily prepared by injection molding, and the draft of the side walls necessary for ejecting the molded pieces from very simple molds will not significantly affect the appearance of the moldings. However, the invention is not limited to the thermoplastic synthetic resin compositions presently preferred as shell materials.

It is one of the important advantages of this invention that the materials of construction for the containers may be chosen freely to suit the contents of a package. Glass or metal may be substituted for the plastic in one or both container shells, and plastic, glass, or other metals may replace the aluminum in the partitions. The partitions may be bonded integrally to compatible shell materials or suitable adhesives may be chosen. The thermally activated plastic coatings specifically described with reference to the drawing may thus be replaced by pressure- or solvent-activated adhesives, but also by solder or other low-melting alloys connecting metallic surface layers of the shells and the partitions, such surface layers themselves being either constituted by the principal structural material of the connected elements or applied thereto by vapor deposition, electrodeposition, and the like. The use of a rubber partition vulcanized to brass plated glass or metal shells is specifically contemplated and merely illustrative of the variations available in the materials of construction for the illustrated shells and partitions.

Two piercing thorns have been shown in FIGS. 1 and 2, but a single thorn may be adequate if at least one of the two liquids 1, 2 is fairly fluid, and modified piercing elements may be preferred if both liquids are very viscous, as disclosed in my copending application Ser. No. 910,864, filed on May 30, 1978.

The protective foil 28 may be omitted from the container shown in FIG. 2, and the bottom wall 6 shown in FIG. 1 may be protected by a frangible foil in the manner of FIG. 2.

The location of the spouts 10, 27 is not critical and an opening may be provided anywhere else in one of the shells which constitute most of the exposed portions of the containers of the invention. Spouts plugged with separate closure members instead of the integral closures illustrated will normally be preferred when the shells are not made of plastic.

It is a common feature of the containers of the invention that they consist of three basic components capable of being manufactured by simple means from inexpensive materials and of being charged and assembled in a manner simple enough to permit complete automation in an obvious manner, not illustrated. If the material of the shell 4 shown in FIG. 1 is rigid metal or glass, a portion of the bottom wall 6 on which the thorns 15, 16 are mounted may be made from material flexible enough to permit the movement of the wall portion together with the thorns into a position of piercing engagement of the foil 13 by the thorn or thorns.

It should be understood, therefore, that the foregoing disclosure relates only to presently preferred embodiments, and that it is intended to cover all changes and modifications of the examples of the invention herein chosen for the purpose of the disclosure which do not constitute departures from the spirit and scope of the invention set forth in the appended claims.

What is claimed is:

1. A container comprising:

(a) a first shell and a second shell, (1) each shell being cup-shaped and having a bottom wall and an annular side wall transverse to said bottom wall, (2) said walls bounding respective cavities in said shells;

(3) each side wall having an annular rim portion remote from the associated bottom wall and bounding a side of the cavity in the shell open toward the other shell;

(b) fastening means fixedly fastening the rim portions of said shells to each other, said fastening means consisting essentially of a frangible partition of sheet material having two opposite major faces separated by the thickness of said partition, said faces being fixedly fastened to said rim portions respectively and respectively sealing the open sides of said cavities from each other; and (c) a piercing member mounted on the bottom wall of said first shell for movement transverse to said major faces into piercing engagement with said partition.

2. A container as set forth in claim 1, wherein a portion of the bottom wall of said first shell is flexible and integrally fastened to said piercing member for said transverse movement therewith.

3. A container as set forth in claim 2, wherein said portion of said bottom wall has a face exposed outside the cavity of said first shell for manual displacement of said portion in said transverse direction.

4. A container as set forth in claim 1, wherein said sheet material includes a metal foil and two layers of adhesive material interposed between said foil and said rim portions respectively, said layers fixedly fastening said foil to said rim portions respectively and constituting the sole means fastening said rim portions to said foil and thereby to each other.

5. A container as set forth in claim 4, wherein said adhesive material consists essentially of thermoplastic synthetic resin composition, the metal in said foil consisting essentially of aluminum.

6. A container as set forth in claim 5, wherein said rim portions consist essentially of thermoplastic synthetic resin composition heat sealed to said adhesive material.

7. A container as set forth in claim 1, wherein said rim portions have respective, cylindrical, annular faces, and said partition has a cylindrical, marginal portion interposed between said annular faces of said rim portions and fixedly fastened to said annular faces in sealing engagement.

8. A container as set forth in claim 1, one of said shells being formed with an opening therethrough, and plugging means for plugging said opening.

9. A two-component package comprising a container as set forth in claim 1 and two different liquids sealed from each other and from the ambient atmosphere in said cavities respectively by said shells and said partition.

* * * * *

UNITED STATES PATENT AND TRADEMARK OFFICE

CERTIFICATE OF CORRECTION

PATENT NO. : 4,174,035

DATED : November 13, 1979

INVENTOR(S) : Georg Wiegner

It is certified that error appears in the above—identified patent and that said Letters Patent is hereby corrected as shown below:

The term of this patent subsequent to August 1, 1995, has been disclaimed.

Signed and Sealed this

*Eighth* Day of *January 1980*

[SEAL]

*Attest:*

SIDNEY A. DIAMOND

*Attesting Officer*

*Commissioner of Patents and Trademarks*